US006862956B1

(12) United States Patent
Chen

(10) Patent No.: US 6,862,956 B1
(45) Date of Patent: Mar. 8, 2005

(54) RATCHET WRENCH

(76) Inventor: Shwu Ruu Chen, No. 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 10/694,257

(22) Filed: Oct. 23, 2003

(51) Int. Cl.[7] ..... B25B 13/46
(52) U.S. Cl. ..... 81/63.2
(58) Field of Search ..... 81/58, 60, 61, 81/62, 63, 63.1, 63.2

(56) References Cited

U.S. PATENT DOCUMENTS 5,913,954 A * 6/1999 Arnold et al. ..... 81/63.2
6,386,072 B1 * 5/2002 Yuan-Chin et al. ..... 81/63.2

* cited by examiner

*Primary Examiner*—Jacob K. Ackun, Jr.

(57) ABSTRACT

A ratchet wrench includes a wrench body, an operation body, a limit plate, a pawl member, a cover plate, a snap ring, and a rotation member. The pawl member is rotated by the limit plate, so that the engaging teeth of the pawl member mesh with the ratchet teeth of the drive head, and the operation body is operated in one direction only by rotation of the drive head. Thus, the ratchet wrench that can be operated easily and conveniently, thereby facilitating the user operating the ratchet wrench.

10 Claims, 7 Drawing Sheets

RATCHET WRENCH

BACKGROUND OF THE INVENTION

1. Field of the Invention

The present invention relates to a ratchet wrench, and more particularly to a ratchet wrench that can be operated easily and conveniently.

2. Description of the Related Art

A conventional ratchet wrench in accordance with the prior art shown in FIG. 1 comprises a wrench body 30 including a handle 31 having an end formed with a drive head 32 having an inner wall formed with a receiving chamber 320 having a periphery formed with a plurality of ratchet teeth 322, an operation body 33 rotatably mounted in the receiving chamber 320 of the drive head 32 and having a top formed with a screw bore 330, a pawl member 38 mounted on the operation body 33 and having a side formed with a plurality of engaging teeth 380 meshing with the ratchet teeth 322 of the drive head 32, a rotation member 34 rotatably mounted on a top of the drive head 32 of the wrench body 30, a screw 36 extended through the rotation member 34 and screwed into the screw bore 330 of the operation body 33, and a coil 39 secured on and driven by the rotation member 34 and secured on the pawl member 38 for pivoting the pawl member 38. Thus, when the rotation member 34 is rotated, the coil 39 is driven by rotation of the rotation member 34 to pivot and move the pawl member 38.

However, the conventional ratchet wrench can withstand a smaller torque, so that it is easily broken due to an excessive torque. In addition, the rotation angle of the rotation member 34 cannot be controlled easily, thereby causing inconvenience to the user. Further, the conventional ratchet wrench is easily jammed due to a larger force.

SUMMARY OF THE INVENTION

The present invention is to mitigate and/or obviate the disadvantage of the conventional ratchet wrench.

The primary objective of the present invention is to provide a ratchet wrench that can be operated easily and conveniently, thereby facilitating the user operating the ratchet wrench.

Another objective of the present invention is to provide a ratchet wrench that can be assembled easily and rapidly.

A further objective of the present invention is to provide a ratchet wrench that is manufactured easily and rapidly, thereby decreasing costs of fabrication.

A further objective of the present invention is to provide a ratchet wrench that has a greater torque, so that it is not easily broken due to an excessive torque.

In accordance with the present invention, there is provided a ratchet wrench, comprising a wrench body, an operation body, a limit plate, a pawl member, a cover plate, a snap ring, and a rotation member, wherein:

the wrench body includes a handle having an end formed with a drive head having an inner wall formed with a receiving chamber having a periphery formed with a plurality of ratchet teeth;

the operation body is rotatably mounted in the receiving chamber of the drive head and has a first side formed with an opening and a second side formed with a receiving recess for receiving a torsion spring, the operation body has a top formed with a protruding threaded support rod;

the limit plate is mounted on the operation body and has a first end formed with limit portion formed with two opposite limit notches;

the pawl member is mounted in the opening of the operation body and has a first side formed with a plurality of engaging teeth meshing with the ratchet teeth of the drive head, the pawl member has a top formed with two opposite stubs each secured in a respective one of the two opposite limit notches of the limit portion of the limit plate, so that the pawl member is rotated by the limit plate;

the cover plate is mounted on the support rod of the operation body and is rested on the limit plate;

the snap ring is snapped on the support rod of the operation body and is rested on the cover plate; and the rotation member is rotatably mounted on a top of the drive head of the wrench body for rotating the limit plate.

Further benefits and advantages of the present invention will become apparent after a careful reading of the detailed description with appropriate reference to the accompanying drawings.

DETAILED DESCRIPTION OF THE INVENTION

Figure 1:
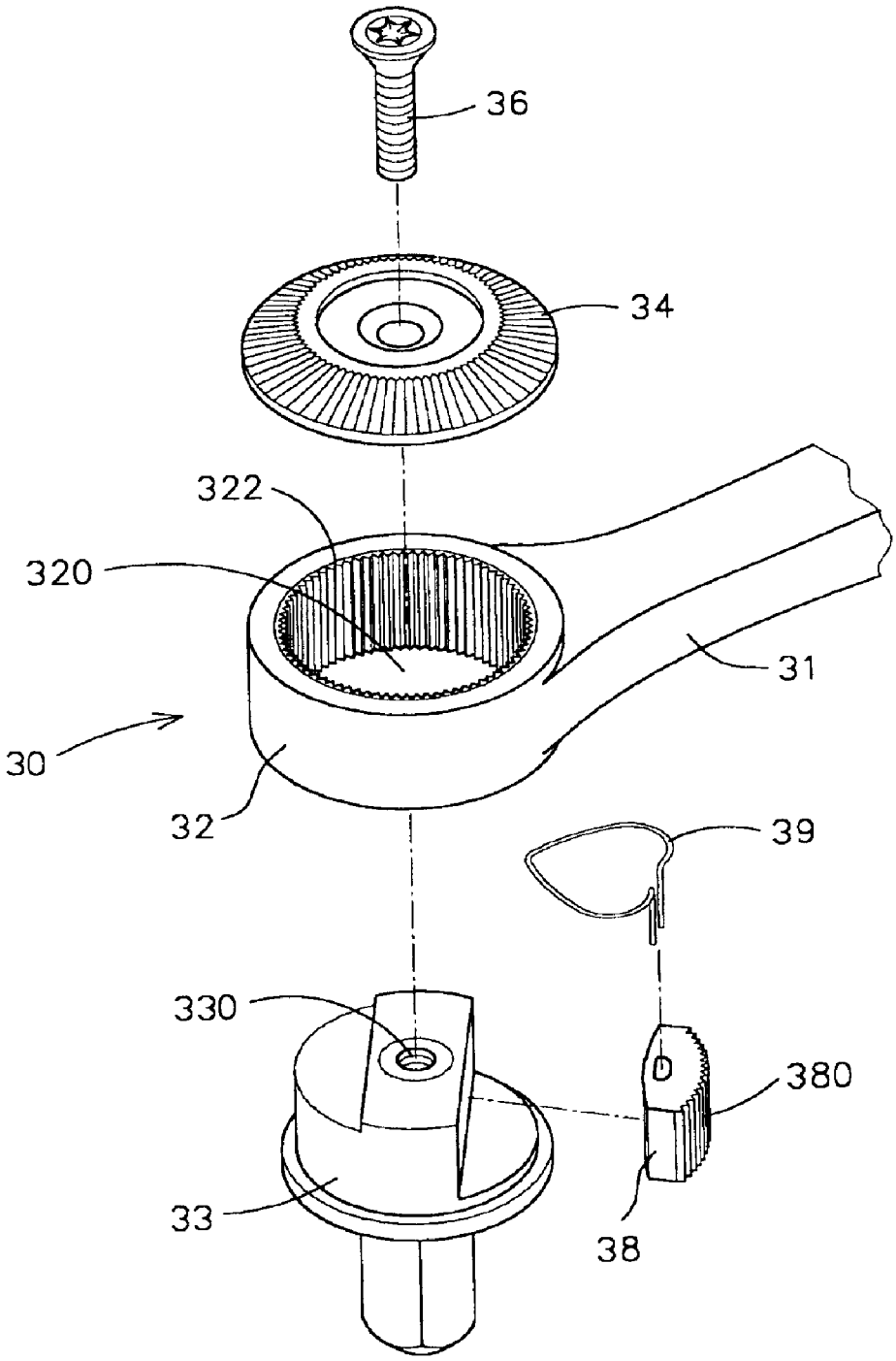
FIG.1 PRIOR ART
FIG. 1 is an exploded perspective view of a conventional ratchet wrench in accordance with the prior art.
Figure 2:
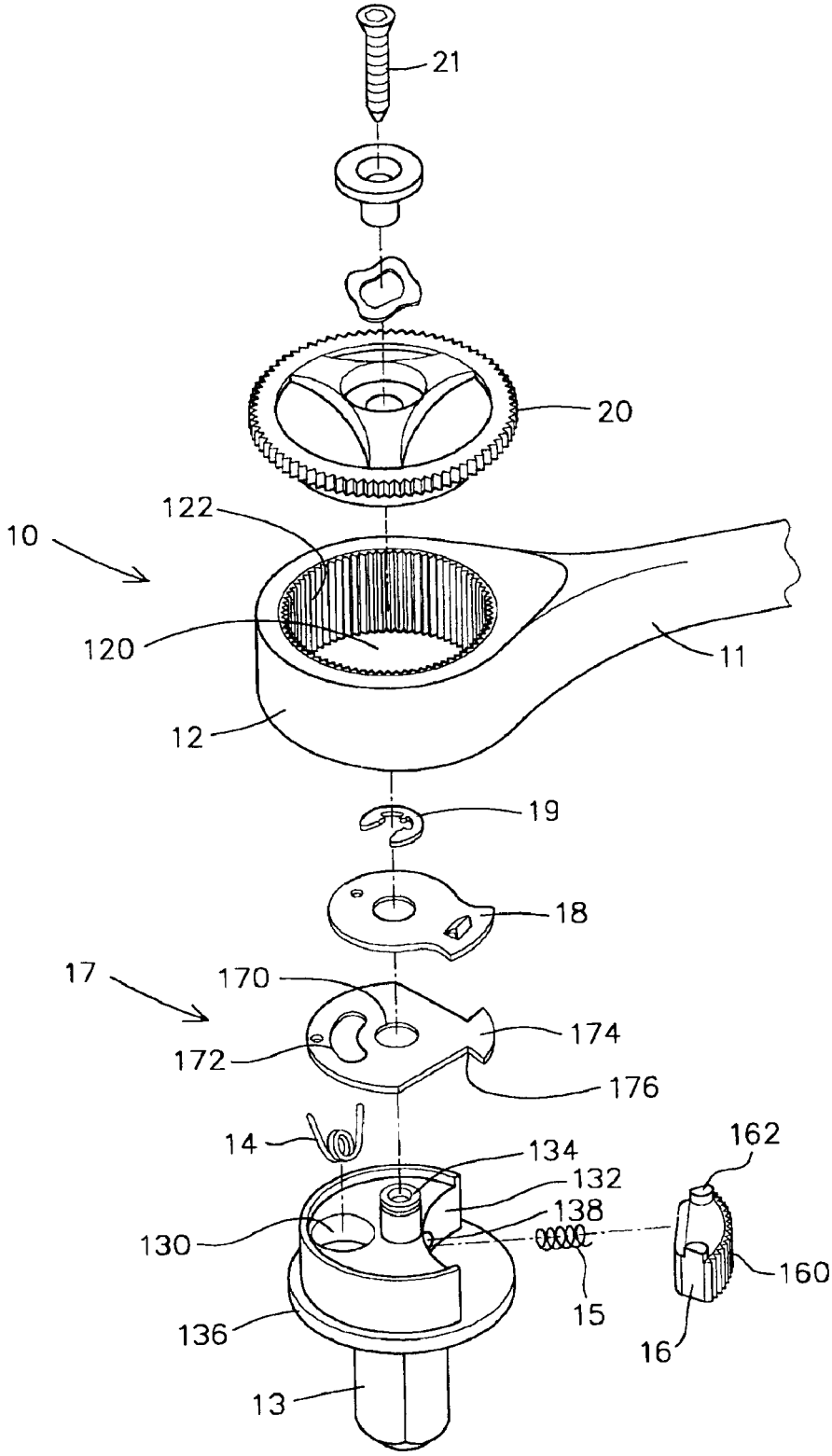
FIG. 2 is a partially cut-away exploded perspective view of a ratchet wrench in accordance with the preferred embodiment of the present invention.
Figure 3:
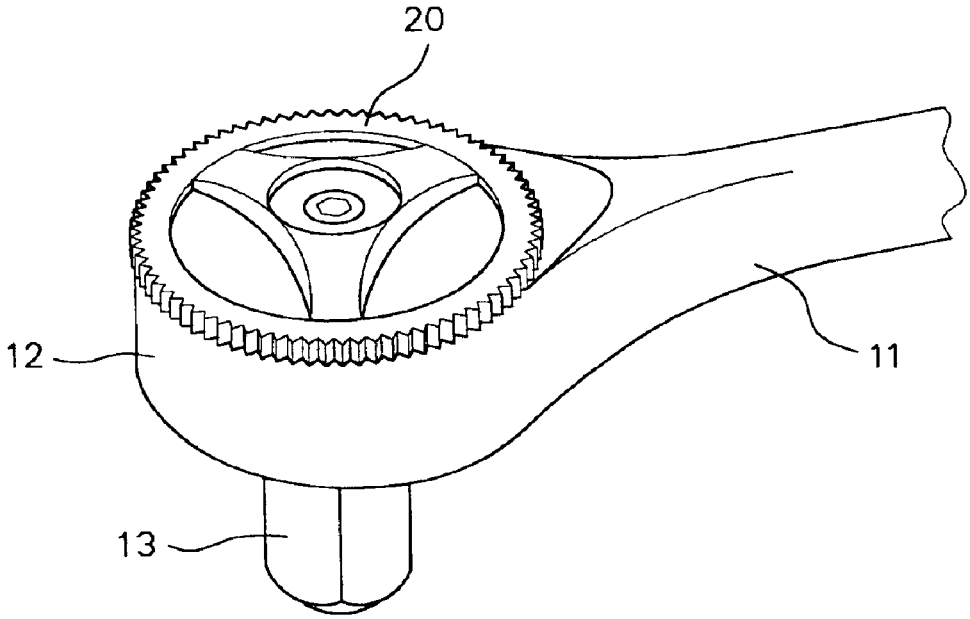
FIG. 3 is a partially cut-away perspective view of the ratchet wrench in accordance with the preferred embodiment of the present invention.
Figure 4:
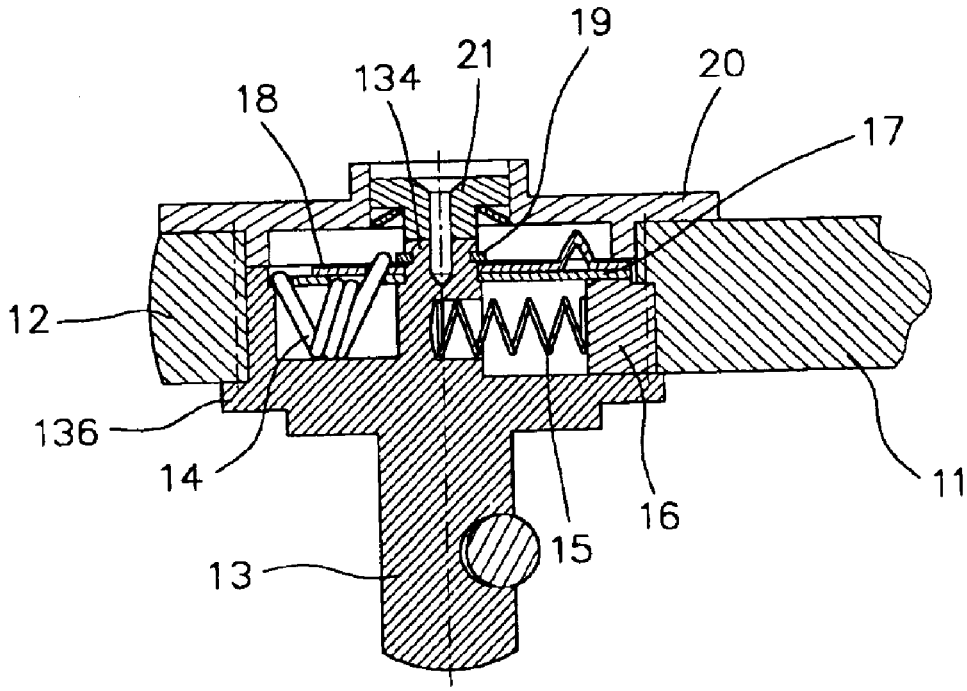
FIG. 4 is a plan cross-sectional view of the ratchet wrench as shown in FIG. 3.

Referring to the drawings and initially to FIGS. 2–5, a ratchet wrench in accordance with the preferred embodiment of the present invention comprises a wrench body 10, an operation body 13, a limit plate 17, a pawl member 16, a cover plate 18, a snap ring 19, and a rotation member 20.

The wrench body 10 includes a handle 11 having an end formed with a drive head 12 having an inner wall formed with a receiving chamber 120 having a periphery formed with a plurality of ratchet teeth 122.

The operation body 13 is rotatably mounted in the receiving chamber 120 of the drive head 12 and has a first side formed with an arc-shaped opening 132 and a second side formed with a receiving recess 130 for receiving a torsion spring 14. The opening 132 of the operation body 13 has a wall formed with a receiving hole 138. The operation body 13 has a top formed with a protruding threaded support rod 134 and a bottom formed with an urging disk 136 rested on a bottom of the drive head 12 of the wrench body 10.

The limit plate 17 is mounted on the operation body 13 and is formed with a through hole 170 for mounting the support rod 134 of the operation body 13. The limit plate 17 has a first end formed with limit portion 174 formed with two opposite limit notches 176 and a second end formed with an arc-shaped slot 172 aligning with the torsion spring 14.

The pawl member 16 is mounted in the opening 132 of the operation body 13 and has a first side formed with a plurality of engaging teeth 160 meshing with the ratchet teeth 122 of the drive head 12. The pawl member 16 has a top formed with two opposite stubs 162 each secured in a respective one of the two opposite limit notches 176 of the limit portion 174 of the limit plate 17, so that the pawl member 16 is rotated by the limit plate 17.

The ratchet wrench further comprises a spring 15 mounted in the opening 132 of the operation body 13 and has a first end urged on the wall of the opening 132 of the operation body 13 and a second end urged on a second side of the pawl member 16. Preferably, the first end of the spring 15 is mounted in the receiving hole 138 of the operation body 13.

The cover plate 18 is mounted on the support rod 134 of the operation body 13 and is rested on the limit plate 17. The torsion spring 14 has a first end secured on the operation body 13 and a second end secured on an end of the cover plate 18.

The snap ring 19 is snapped on the support rod 134 of the operation body 13 and is rested on the cover plate 18.

The rotation member 20 is rotatably mounted on a top of the drive head 12 of the wrench body 10 for rotating the limit plate 17. The rotation member 20 is mounted on the drive head 12 of the wrench body 10 by a screw which is screwed into the support rod 134 of the operation body 13.

Figure 5:
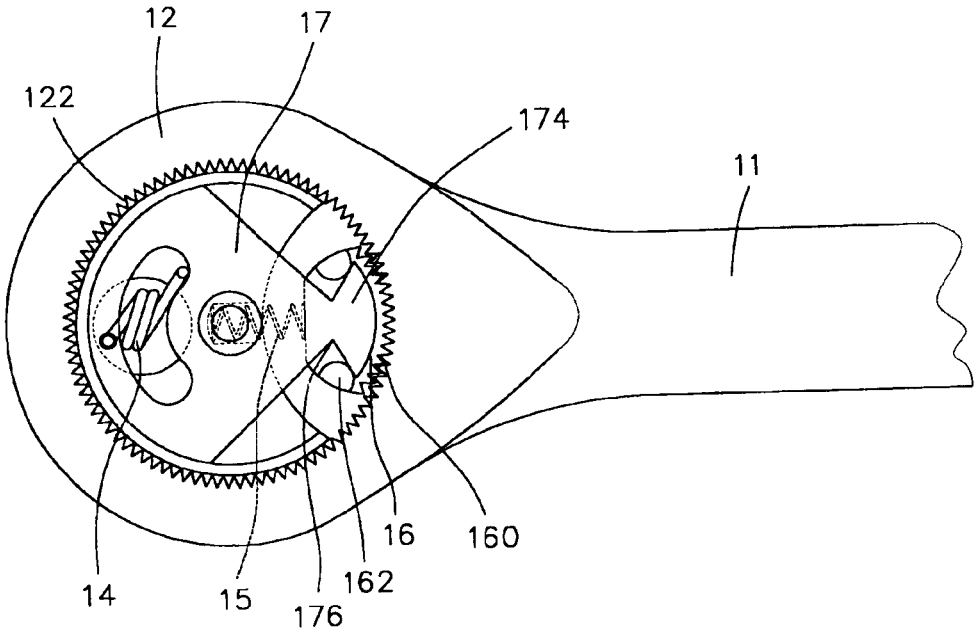
FIG. 5 is a top plan view of the ratchet wrench as shown in FIG. 3.
Figure 6:
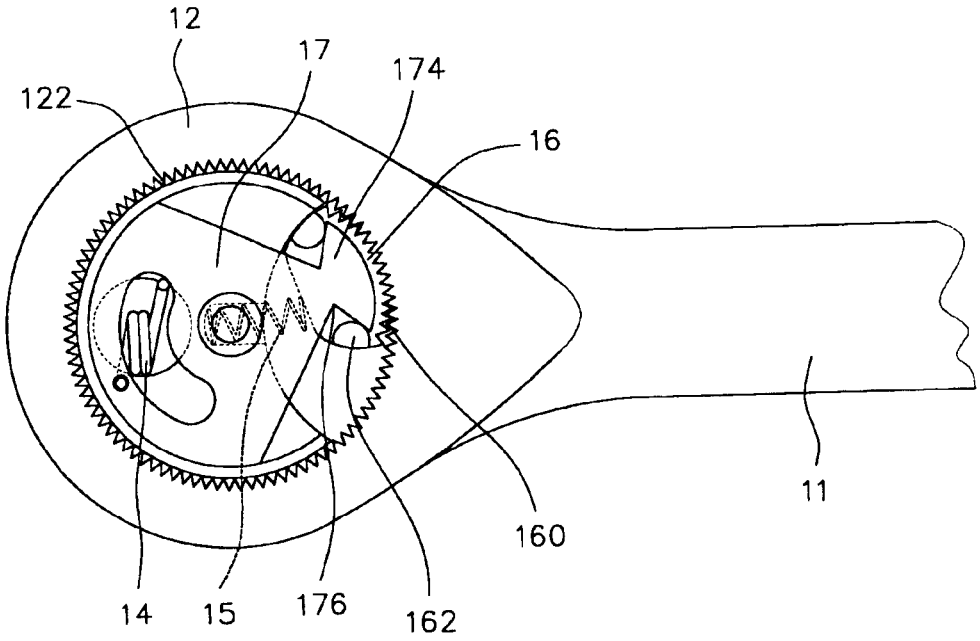
FIG. 6 is a schematic operational view of the ratchet wrench as shown in FIG. 5.
Figure 7:
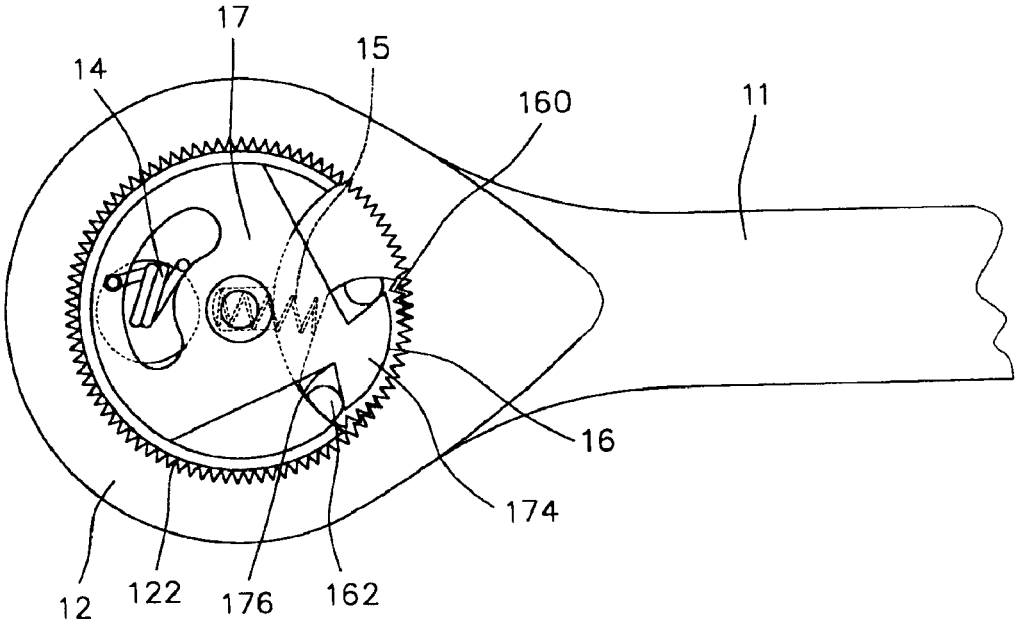
FIG. 7 is a schematic operational view of the ratchet wrench as shown in FIG. 5

In operation, referring to FIGS. 2–7, when the rotation member 20 is rotated, the pawl member 16 is rotated by the limit plate 17 to move from the position as shown in FIG. 5 to the position as shown in FIG. 6 (in the counterclockwise direction) or to the position as shown in FIG. 7 (in the clockwise direction), so that the engaging teeth 160 of the pawl member 16 mesh with the ratchet teeth 122 of the drive head 12. Thus, the operation body 13 is operated in one direction only by rotation of the drive head 12.

Accordingly, the ratchet wrench can be operated easily and conveniently, thereby facilitating the user operating the ratchet wrench. In addition, the ratchet wrench can be assembled easily and rapidly. Further, the ratchet wrench is manufactured easily and rapidly, thereby decreasing costs of fabrication. Further, the ratchet wrench has a greater torque, so that it is not easily broken due to an excessive torque.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench, comprising a wrench body, an operation body, a limit plate, a pawl member, a cover plate, a snap ring, and a rotation member, wherein:

the wrench body includes a handle having an end formed with a drive head having an inner wall formed with a receiving chamber having a periphery formed with a plurality of ratchet teeth;

the operation body is rotatably mounted in the receiving chamber of the drive head and has a first side formed with an opening and a second side formed with a receiving recess for receiving a torsion spring, the operation body has a top formed with a protruding threaded support rod;

the limit plate is mounted on the operation body and has a first end formed with limit portion formed with two opposite limit notches;

the pawl member is mounted in the opening of the operation body and has a first side formed with a plurality of engaging teeth meshing with the ratchet teeth of the drive head, the pawl member has a top formed with two opposite stubs each secured in a respective one of the two opposite limit notches of the limit portion of the limit plate, so that the pawl member is rotated by the limit plate;

the cover plate is mounted on the support rod of the operation body and is rested on the limit plate;

the snap ring is snapped on the support rod of the operation body and is rested on the cover plate; and the rotation member is rotatably mounted on a top of the drive head of the wrench body for rotating the limit plate.

2. The ratchet wrench in accordance with claim 1, wherein the opening of the operation body is arc-shaped.

3. The ratchet wrench in accordance with claim 1, wherein the operation body has a bottom formed with an urging disk rested on a bottom of the drive head of the wrench body.

4. The ratchet wrench in accordance with claim 1, wherein the limit plate is formed with a through hole for mounting the support rod of the operation body.

5. The ratchet wrench in accordance with claim 1, wherein the limit plate has a second end formed with an arc-shaped slot aligning with the torsion spring.

6. The ratchet wrench in accordance with claim 1, further comprising a spring mounted in the opening of the operation body and has a first end urged on the wall of the opening of the operation body and a second end urged on a second side of the pawl member.

7. The ratchet wrench in accordance with claim 6, wherein the opening of the operation body has a wall formed with a receiving hole, and the first end of the spring is mounted in the receiving hole of the operation body.

8. The ratchet wrench in accordance with claim 1, wherein the torsion spring has a first end secured on the operation body and a second end secured on an end of the cover plate.

9. The ratchet wrench in accordance with claim 1, wherein the rotation member is mounted on the drive head of the wrench body by a screw.

10. The ratchet wrench in accordance with claim 9, wherein the screw is screwed into the support rod of the operation body.

* * * * *